US008635831B2

(12) United States Patent
Rivers

(10) Patent No.: US 8,635,831 B2
(45) Date of Patent: Jan. 28, 2014

(54) SPACE TRUSS SYSTEM

(76) Inventor: Paul Rivers, Jackson, WY (US)

( * ) Notice: Subject to any disclaimer, the term of this patent is extended or adjusted under 35 U.S.C. 154(b) by 0 days.

(21) Appl. No.: 13/604,794

(22) Filed: Sep. 6, 2012

(65) Prior Publication Data

US 2013/0067847 A1 Mar. 21, 2013

Related U.S. Application Data

(60) Provisional application No. 61/533,145, filed on Sep. 9, 2011.

(51) Int. Cl.

| | |
|---|---|
| ***E04H 12/00*** | (2006.01) |
| ***E04B 9/00*** | (2006.01) |
| ***E06B 3/54*** | (2006.01) |
| ***E04B 1/19*** | (2006.01) |
| *F27D 1/00* | (2006.01) |

(52) U.S. Cl.
CPC .. *E04B 1/19* (2013.01); *F27D 1/004* (2013.01)
USPC ..... 52/652.1; 52/479

(58) Field of Classification Search
USPC ..... 52/634, 636, 654.1, 652, 655.4, 650.3, 52/648.1, 633, 643, 638, 645, 651.1, 646, 52/693, 696, 655.1, 479; 403/194, 495, 403/238–239, 243, 261, 95
See application file for complete search history.

(56) References Cited

U.S. PATENT DOCUMENTS

| | | | | |
|---|---|---|---|---|
| 3,086,899 | A | 4/1963 | Ingraham | |
| 3,884,646 | A * | 5/1975 | Kenney | 428/593 |
| 3,948,012 | A | 4/1976 | Papayoti | |
| 4,223,053 | A | 9/1980 | Brogan | |
| 4,923,544 | A | 5/1990 | Weisse | |
| 5,070,673 | A | 12/1991 | Weisse | |
| 5,315,806 | A | 5/1994 | Da Casta Trias de Bes | |
| 5,654,518 | A | 8/1997 | Dobbs | |
| 5,958,551 | A | 9/1999 | Garcia-Ochoa | |
| 6,200,664 | B1 | 3/2001 | Figge | |
| 6,207,256 | B1 | 3/2001 | Tashiro | |
| 6,644,535 | B2 | 11/2003 | Wallach | |
| 7,231,745 | B1 | 6/2007 | Shoji | |
| 7,963,084 | B2 * | 6/2011 | Merrifield et al. | 52/646 |
| 7,963,085 | B2 | 6/2011 | Sypeck | |
| 2008/0155931 | A1 | 7/2008 | Shoji | |
| 2009/0274865 | A1 * | 11/2009 | Wadley et al. | 428/110 |
| 2009/0286100 | A1 * | 11/2009 | Wadley et al. | 428/593 |
| 2010/0192507 | A1 * | 8/2010 | Studebaker et al. | 52/655.1 |

* cited by examiner

*Primary Examiner* — William Gilbert
*Assistant Examiner* — Kyle Walraed-Sullivan
(74) *Attorney, Agent, or Firm* — Marger Johnson & McCollom PC

(57) ABSTRACT

A space truss system for use in foundations, floors, walls, and roofs is provided. The space truss system comprises structural rods with each structural rod having a first portion having a first end and a second end, a middle portion having a first end and a second end, and a second end portion having a first end and a second end. The second end of the first portion is joined to the first end of the middle portion at a first predetermined angle and the second end of the middle portion is joined to the second end of the second portion at a second predetermined angle. The first portions of a portion of the structural rods are grouped together forming a first pyramid structure with the first ends of the middle portions forming an apex and the second ends of the middle portions forming a base.

12 Claims, 14 Drawing Sheets

SPACE TRUSS SYSTEM

The present application claims benefit of priority of pending provisional patent application Ser. No. 61/533,145, filed on Sep. 9, 2011, entitled "Space Truss Panel".

BACKGROUND OF THE INVENTION

1. Field of the Invention

This invention relates generally to a space truss system and, more particularly, the invention relates to a space truss system providing a cost effective building system, usable for foundations, floors, walls, and roofs.

2. Description of the Prior Art

Where large spans occur, lightweight steel trusses cart be combined into a folded slab arrangement to cover a roof area. Joining the ridges and the bottom chords produces a more efficient structure due to the fact that it is now spanning two directions and supported at four points.

Space frames are not always economical to construct doe to the fact that much material is required and they tend to be expensive and difficult to maintain. They can be economical in situations where there is a long span and a flat roof with minimum required support. Space frames may also have a pitch or arch element introduced to them.

The space frame acts in a similar manner to the triangulated plane frame except for the fact that the space frame acts in three dimensional manner. Space frames have other uses, towers and tail masts are usually built as space frames due to the fact that they can not be easily constructed in another way. It is worth mentioning that the domestic pitched roof is also a space frame.

SUMMARY

The present invention is a space truss system for use in foundations, floors, walls, and roofs. The space truss system comprises a plurality of structural rods with each structural rod having a first portion having a first end and a second end, a middle portion having a first end and a second end, and a second end portion having a first end and a second end. The second end of the first portion is joined to the first end of the middle portion at a first predetermined angle and the second end of the middle portion is joined to the second end of the second portion at a second predetermined angle. The first portions of at least a portion of the structural rods are grouped together forming a first pyramid structure with the first ends of the middle portions forming an apex of the first pyramid structure and the second ends of the middle portions forming a base of the first pyramid structure.

DETAILED DESCRIPTION OF THE PREFERRED EMBODIMENTS

As illustrated in FIGS. 1-20, the present invention is a space truss system, indicated generally at 10, providing a cost effective building system usable for foundations, floors, walls, and roofs. The space truss system 10 of the present invention provides increased spanning distance and strength at an inexpensive price with the use of readily available materials and no complex unions.

Figure 1:
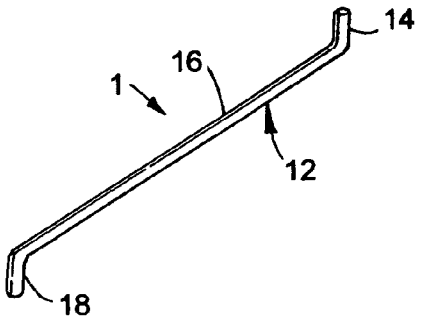
FIG. 1 is a perspective view illustrating an individual structural rod of a space truss system, constructed in accordance with the present invention.
Figure 2:
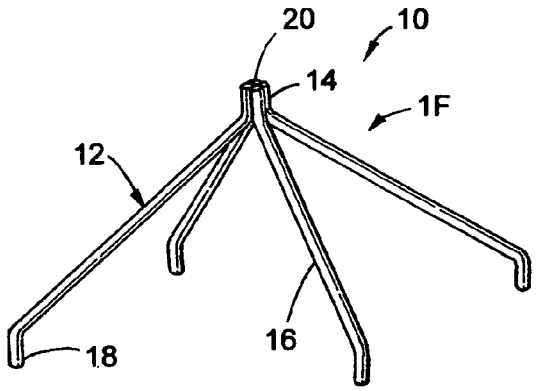
FIG. 2 is a perspective view illustrating a grouping of individual structural rods of the space truss system, constructed in accordance with the present invention.

As best illustrated in FIGS. 1 and 2, the space truss system 10 of the present invention comprises a plurality of structural rods 12 secured together to form a pyramidal element. Each structural rod 12 comprises a first portion 14 having a first end and a second end, a middle portion 16 having a first end and a second end, and a second portion 18 having a first end and a second end. The second end of the first portion 14 is joined to the first end of the middle portion 16 and the second end of the middle portion 16 is joined to the second end of the second portion 18. It should be noted that while the actual lengths of the first portion 14, the middle portion 16, and the second portion 18 can vary depending the requirements of the desired space truss system 10, it is preferable that the length of the first portion 14 is substantially equal to the length of the second portion 18.

In a preferred embodiment, the first portion 14, the middle portion 16, and the second portion 18 of the space truss system 10 of the present invention are formed from a single piece of material. It is, however, within the scope of the present invention to form the first portion 14, the middle portion 16, and the second portion 18 from different pieces of material with the second ends of the first portion 14 and the second portion 18 welded or otherwise secured to the first end and the second end of the middle portion 16, respectively.

The first portion 14 is joined to the middle portion 16 at a first predetermined angle and the second portion 18 is joined to the middle portion 16 at a second predetermined angle. In a preferred embodiment, the first predetermined angle is equal to the second predetermined angle such that the first portion 14 and the second portion 18 are parallel to each other although having the first predetermined angle and the second predetermined angle being non-equal to each other and the first portion 14 and the second portion 18 being non-parallel to each other is within the scope of the present invention. Furthermore, preferably, the first predetermined angle is approximately forty-five (45°) degrees and the second predetermined angle is approximately forty-five (45°) degrees although having the first predetermined angle and the second predetermined angle being less than or greater than approximately forty-five (45°) degrees is within the scope of the present invention.

To a form the space truss system 10 of the present invention, a plurality of structural rods 12 are grouped together to form a "pyramid" structure. Preferably, to group the structural rods 12, the first portions 14 of a plurality of structural rods 12 are positioned together with the first ends of the middle portions 16 forming the "apex" of the pyramid structure and the second ends of the middle portions 16 forming the "base" of the pyramid structure. The grouping of the first portions 14 together create a first post 20 for use with a diaphragm, as will be described in further detail below.

Figure 9:
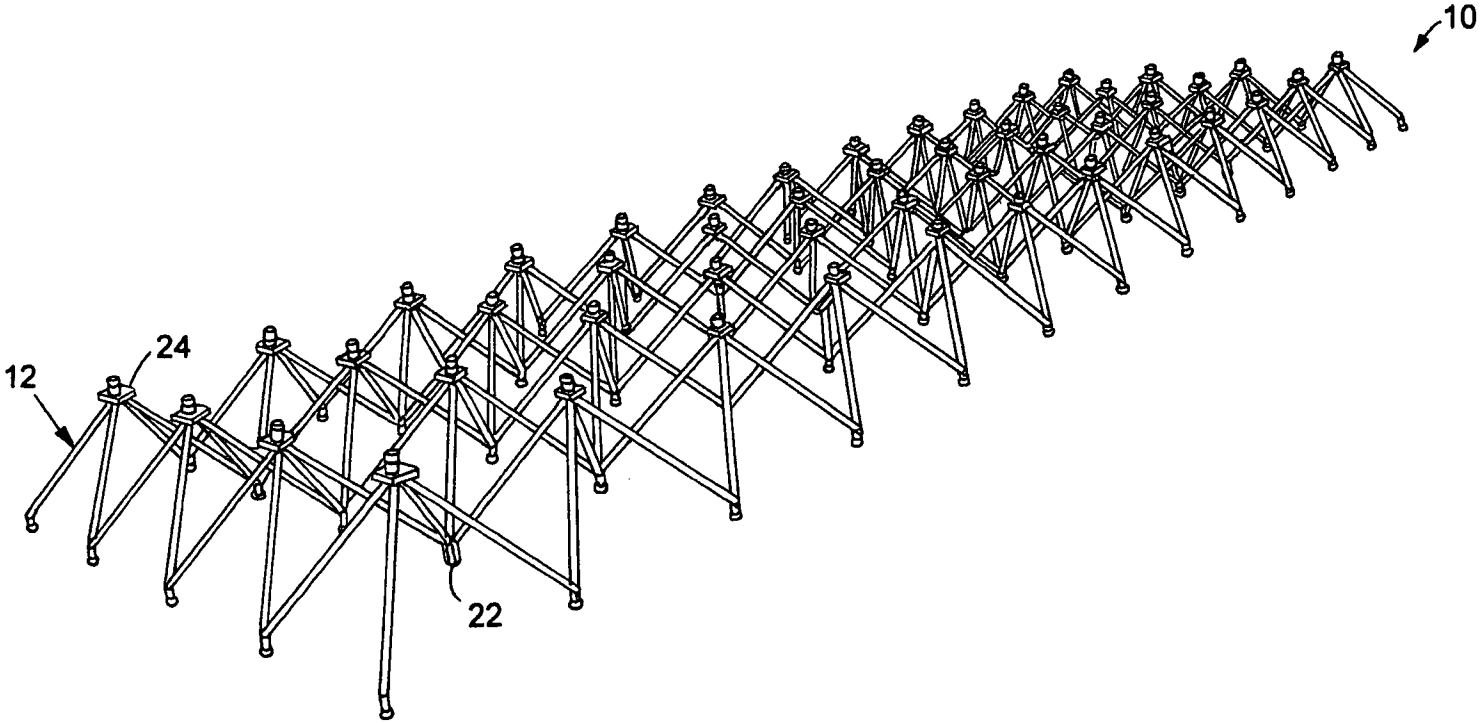
FIG. 9 is a perspective view illustrating a plurality of grouped structural rods creating the space truss system, constructed in accordance with the present invention.

Depending on the desired size and strength of the space truss system 10 of the present invention, upon assembly of the first portions 14 forming the apex, the second portions 18 of adjacent grouped structural rods 12 are securable together with the second ends of the middle portions 16 forming another "apex" of an opposing pyramid structure with the first ends of the middle portions 16 of these grouped structural rods 12 forming another "base". The grouping of the second portions 18 together create a second post 22 for use with another diaphragm, as will be described in further detail below. As best illustrated in FIG. 9, and understood by those persons skilled in the art, the process of grouping first portions 14 and second portions 18 can continue creating as large a space truss system 10, as desired.

Figure 3:
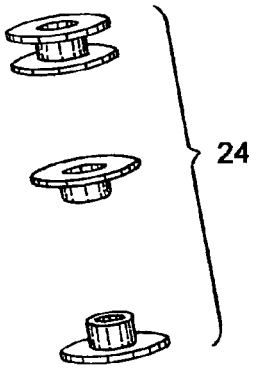
FIG. 3 is a perspective view illustrating diaphragm inserts, both separated and joined together, for use with the structural rods of the space truss system, constructed in accordance with the present invention.
Figure 4:
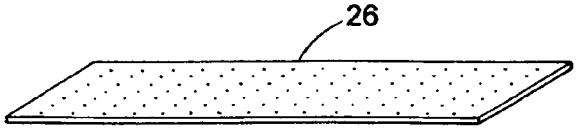
FIG. 4 is a perspective view illustrating a pre-drilled diaphragm of the space truss system, constructed in accordance with the present invention.
Figure 6:
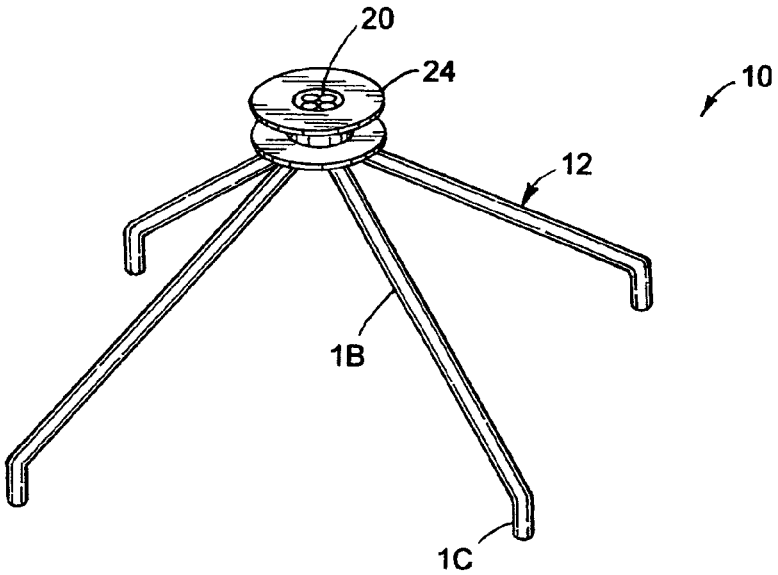
FIG. 6 is a perspective view illustrating the grouped structural rods and the diaphragm inserts of the space truss system, constructed in accordance with the present invention, subsequent to mounting of the diaphragm inserts on the ends of the grouped structural rods.
Figure 5:
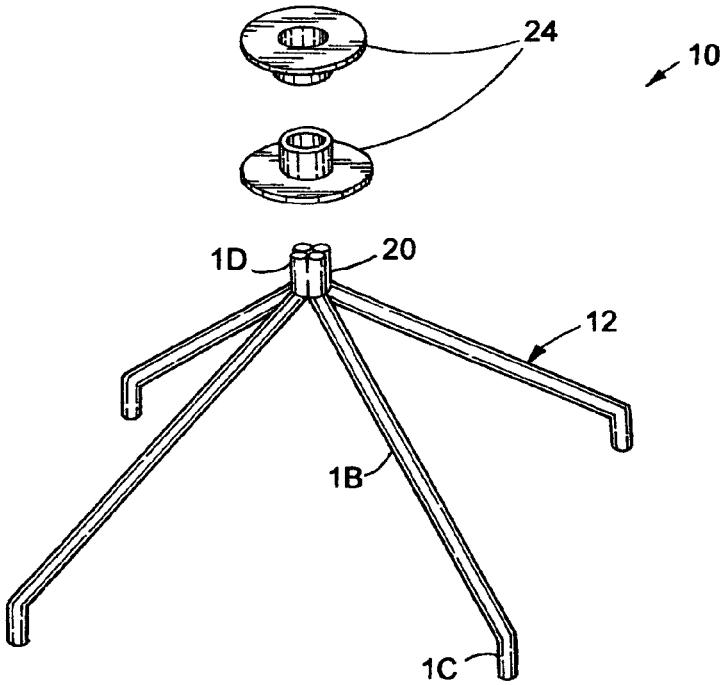
FIG. 5 is a perspective view illustrating the grouped structural rods and the diaphragm inserts of the space truss system, constructed in accordance with the present invention, prior to mourning of the diaphragm inserts on the ends of the grouped structural rods.
Figure 7:
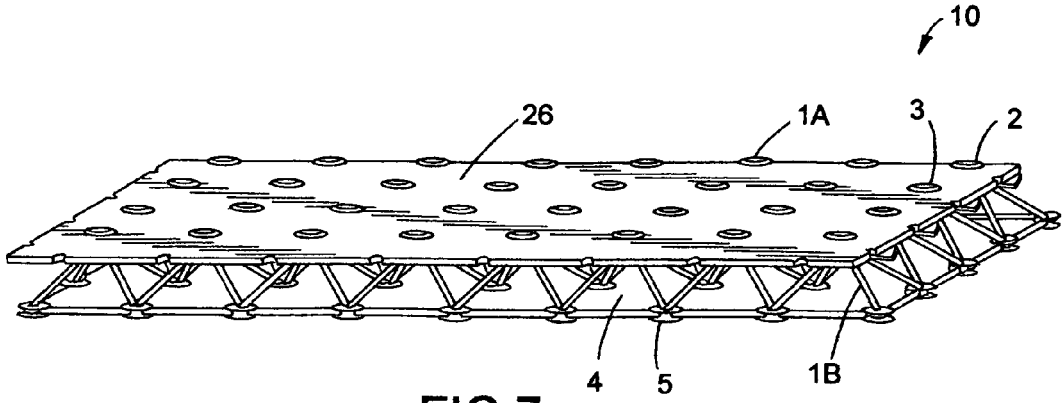
FIG. 7 is a perspective view illustrating the space truss system, constructed in accordance with the present invention, with diaphragm inserts securing the grouped structural rods to the diaphragm.
Figure 8:
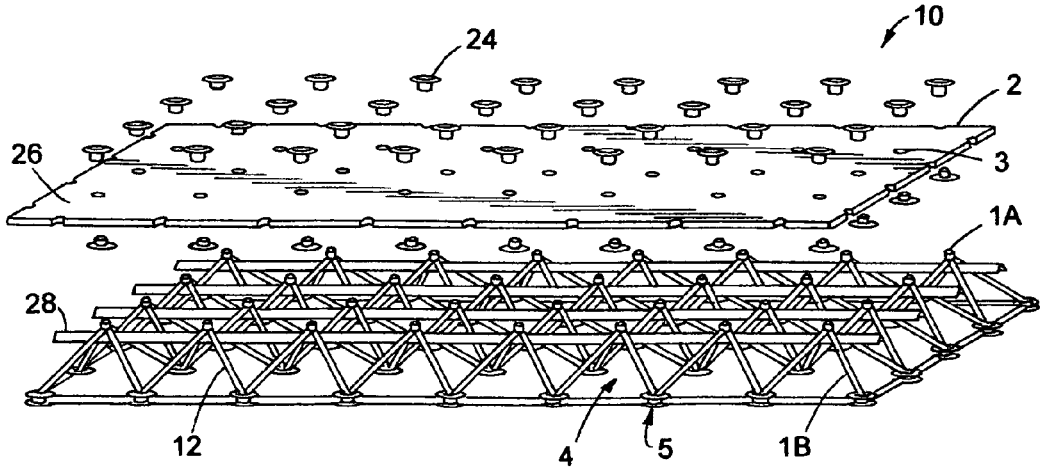
FIG. 8 is a perspective view illustrating another embodiment of the space truss system, constructed in accordance with the present invention, with angle irons mounted between the grouped structural rods for additional strength.

In the space truss system 10 of the present invention, the joining of the first portions 14 together and the second portions 18 together is preferably accomplished by welding. However, it is within the scope of the present invention to join the first portions 14 together and the second portions 18 together by other means including, but not limited to, mechanical fasteners 24, as best illustrated in FIGS. 3, 5, and 6.

Preferably, in the space truss system 10 of the present invention, upon grouping the first portions 14 of the plurality of structural rods 12 together and/or grouping the second portions 18 of the plurality of structural rods 12 together, the angle between each pair of adjacent structural rods 12 is substantially equal. For instance, with three grouped structural rods 12, the angle between each pair of adjacent structural rods 12 is approximately one hundred and twenty (120°) degrees. With four grouped structural rods 12, the angle between each pair of adjacent structural rods 12 is approximately ninety (90°) degrees. With five grouped structural rods 12, the angle between each pair of adjacent structural rods 12 is approximately seventy-two (72°) degrees. It should be noted that the number of structural rods 12 grouped together can vary depending on the intended use of the space truss system 10, but, in a preferred embodiment, the number of structural rods 12 grouped together is four (4). The important fact is that the grouped structural rods 12 form the pyramid structure of foe space truss system 10, as will be described in further detail below.

As briefly mentioned above, and as best illustrated in FIGS. 4, 7, and 8, in an embodiment of the space truss system 10 of the present invention, the space truss system 10 includes a first diaphragm 26 having a first plurality of uniformly sized and uniformly shaped apertures spaced at regular intervals and disposed therethrough. Each of the grouped first portions 14 of the grouped structural, rods 12, i.e., the first posts 20, is receivable within one of the apertures of the first diaphragm 26. A second diaphragm can be detachably connectable in a fixed, spaced relationship by the structural rods 12 to the first diaphragm 26 with the second diaphragm having an additional plurality of uniformly sized and uniformly shaped apertures spaced at regular intervals disposed therethrough with each of the second posts 22 insertable within one of the apertures of the second diaphragm.

In an embodiment of the space truss system 10 of the present invention the first diaphragm 26 is positioned perpendicular to a longitudinal centerline of the first portions 14 and the second diaphragm is positioned perpendicular to an additional longitudinal centerline of the second portions 18. It should be noted that the space truss system 10 can be constructed forming bends or curves, by changing the structural rods 12 lengths or placement(s) at the apex. The first diaphragm 26 and/or the second diaphragm do not have to be flat. In addition, the pyramidal structures created by the grouped structural rods 12 can be attached top and bottom to the first diaphragm 26 and the second diaphragm by the use of barrel bolts or like fasteners or by internal or external post and diaphragm inserts, fasteners, or threads.

Figure 10:
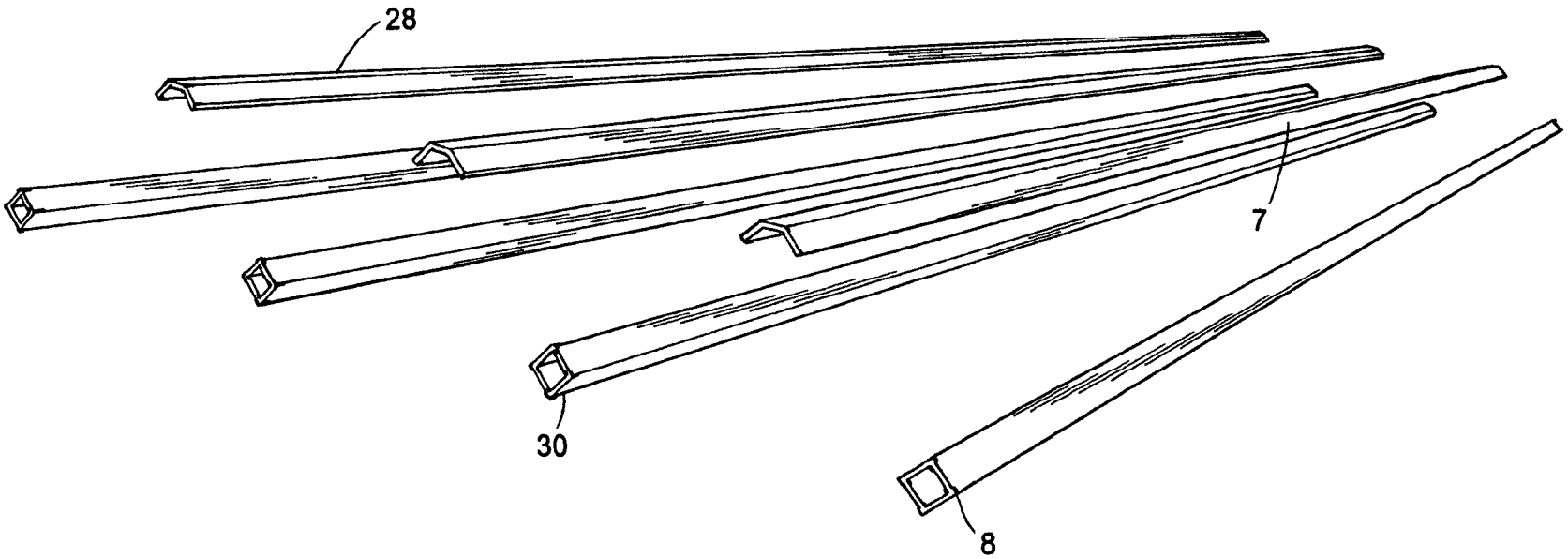
FIG. 10 is a perspective view illustrating various angle irons and square tubes for use with tire space truss system, constructed in accordance with the present invention.
Figure 11:
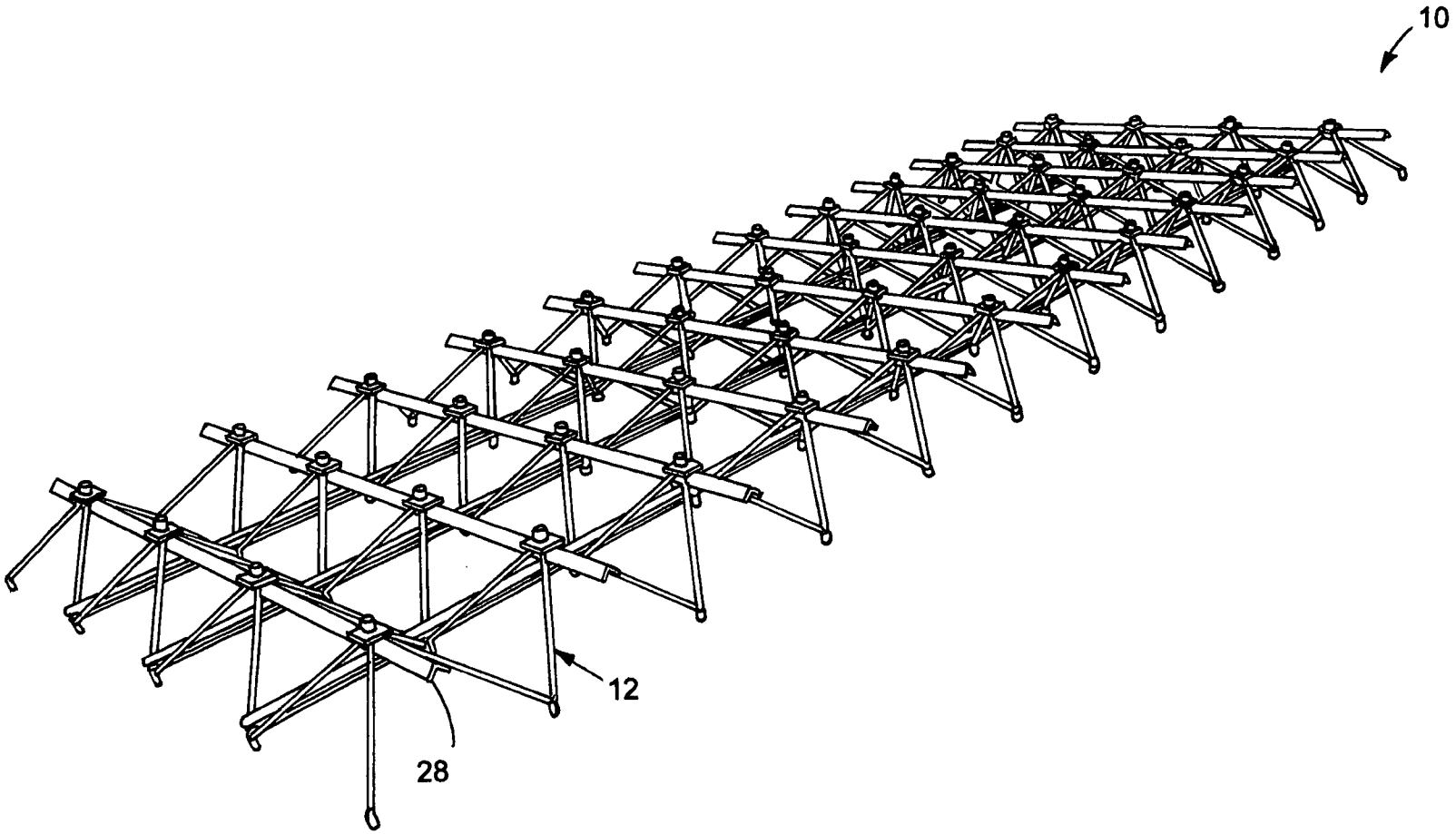
FIG. 11 is a perspective view illustrating still another embodiment of the space truss system, constructed in accordance with the present invention, with angle irons and bearing plate washers mounted between the grouped structural rods for additional strength.
Figure 12:
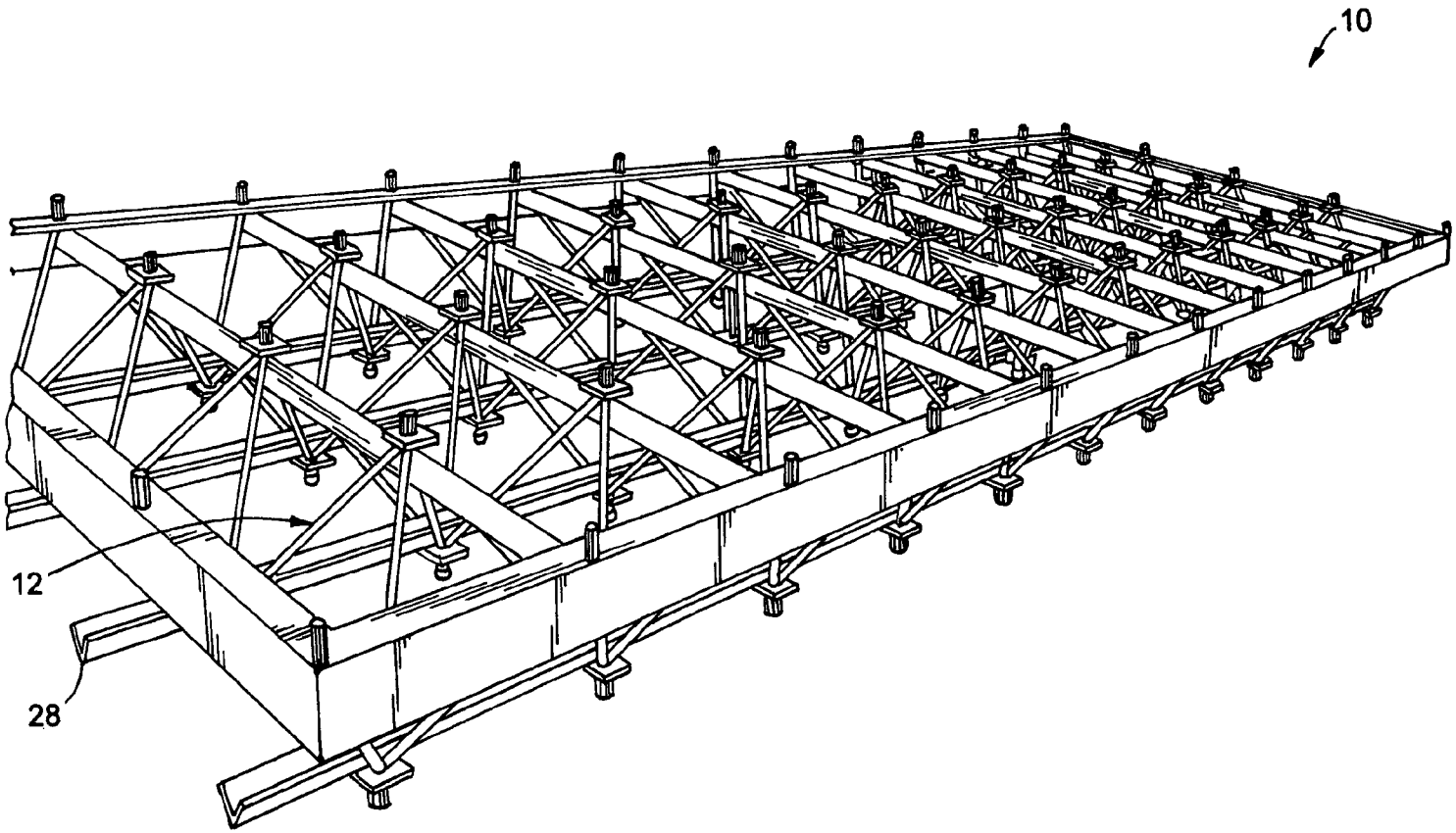
FIG. 12 is a perspective view illustrating yet another embodiment of the space truss system, constructed in accordance with the present invention.
Figure 13:
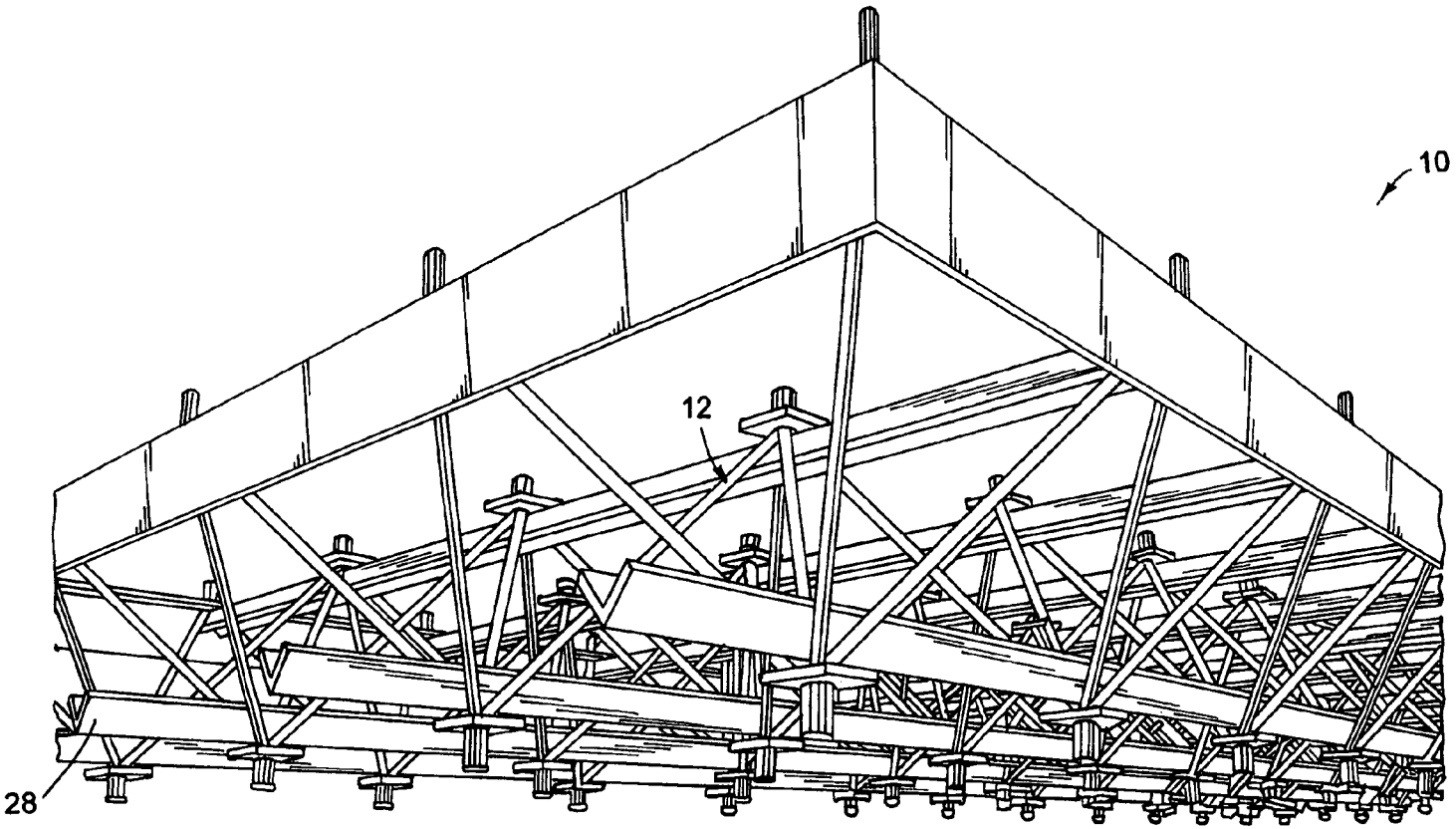
FIG. 13 is another perspective view illustrating the space truss system of FIG. 12, constructed in accordance with the present invention.

As best illustrated in FIGS. 10 and 11, the space truss system 10 of the present invention can be strengthened by using angle irons 28, square metal tubes 30, and/or hearing joists 34 mounted directly beneath the grouped first portions 14 or directly above the grouped second portions 18 within at the first end and the second end, respectively, of the middle portions 16. The angle iron frame 28 "confines" an array of pyramidal elements. The internal angle iron(s) 28 form an internal diaphragm adding support and inhibiting deflection. It should be noted that the angle iron's 28 size can increase or decrease according to structural needs in addition to a variety of sizes, i.e., a heavier angle iron 28 in the center of the width of the panel. Or, instead of angle iron 28, fee square tubing 30 or bearing joists 34 can be used. Anything having at least one ninety (90°) degrees fits perfectly into the space below the apex. Those components are welded (or glued, etc.) to the structural rods forming the pyramidal units. Different designs of panels could have many possibilities. While a space truss system 10 can be constructed without the perimeter angle iron 28, by bolting the mating edges of the angle iron(s) 28 together (and/or welding), the strength of the space truss system 10 is increased. Other positions for the angle irons 28 and square metal tubes 30 are within the scope of the present invention.

Figure 14:
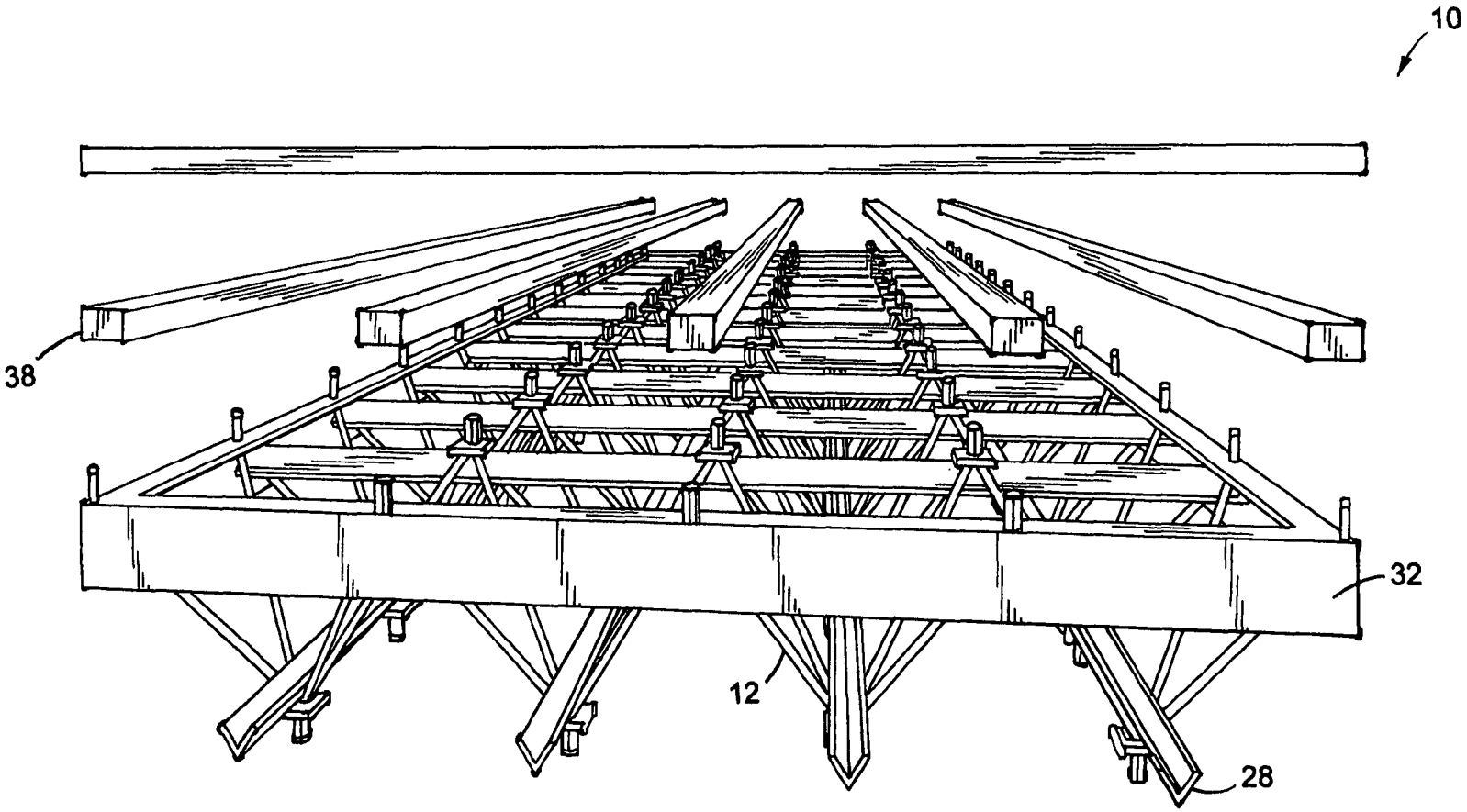
FIG. 14 is an exploded perspective view illustrating a space truss system, constructed in accordance with the present invention, for supporting a wood deck structure.
Figure 15:
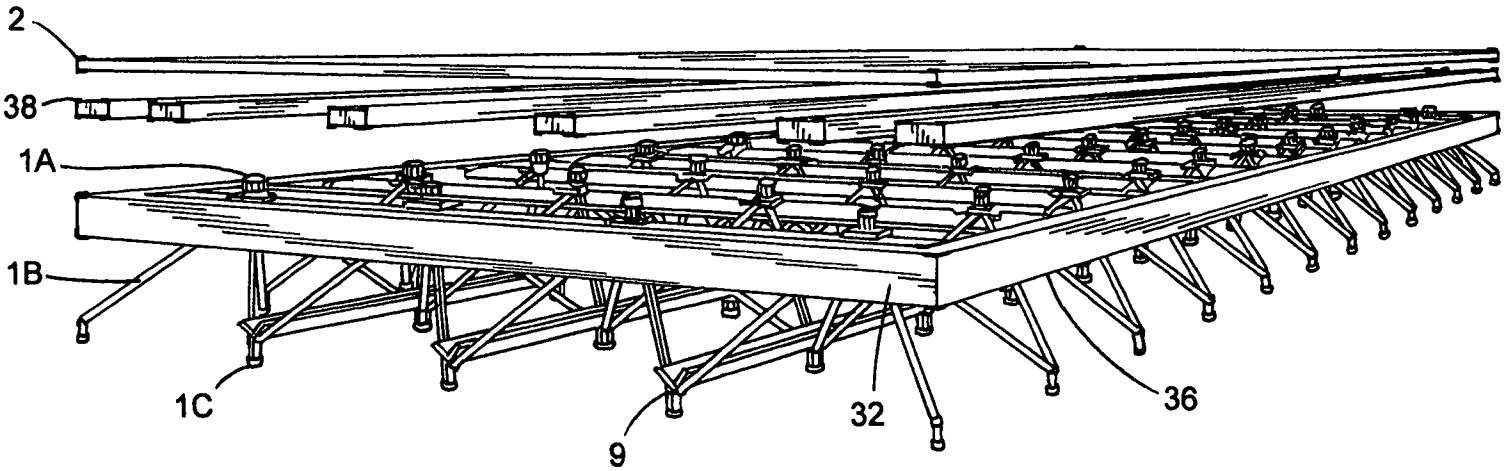
FIG. 15 is an exploded perspective view illustrating the space truss system of FIG. 14, constructed in accordance with the present invention.
Figure 16:
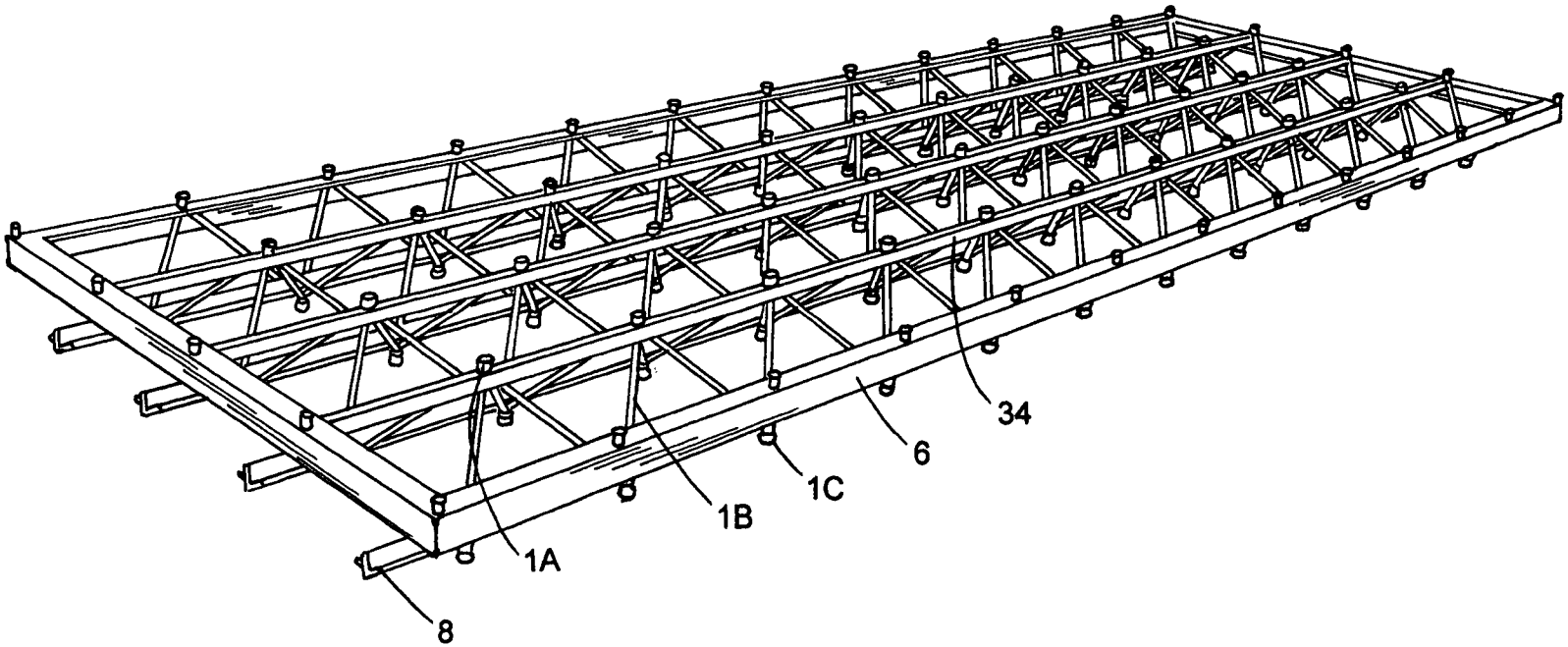
FIG. 16 is perspective view illustrating a space truss system, constructed in accordance with the present invention, for supporting a steel deck frame structure.
Figure 17:
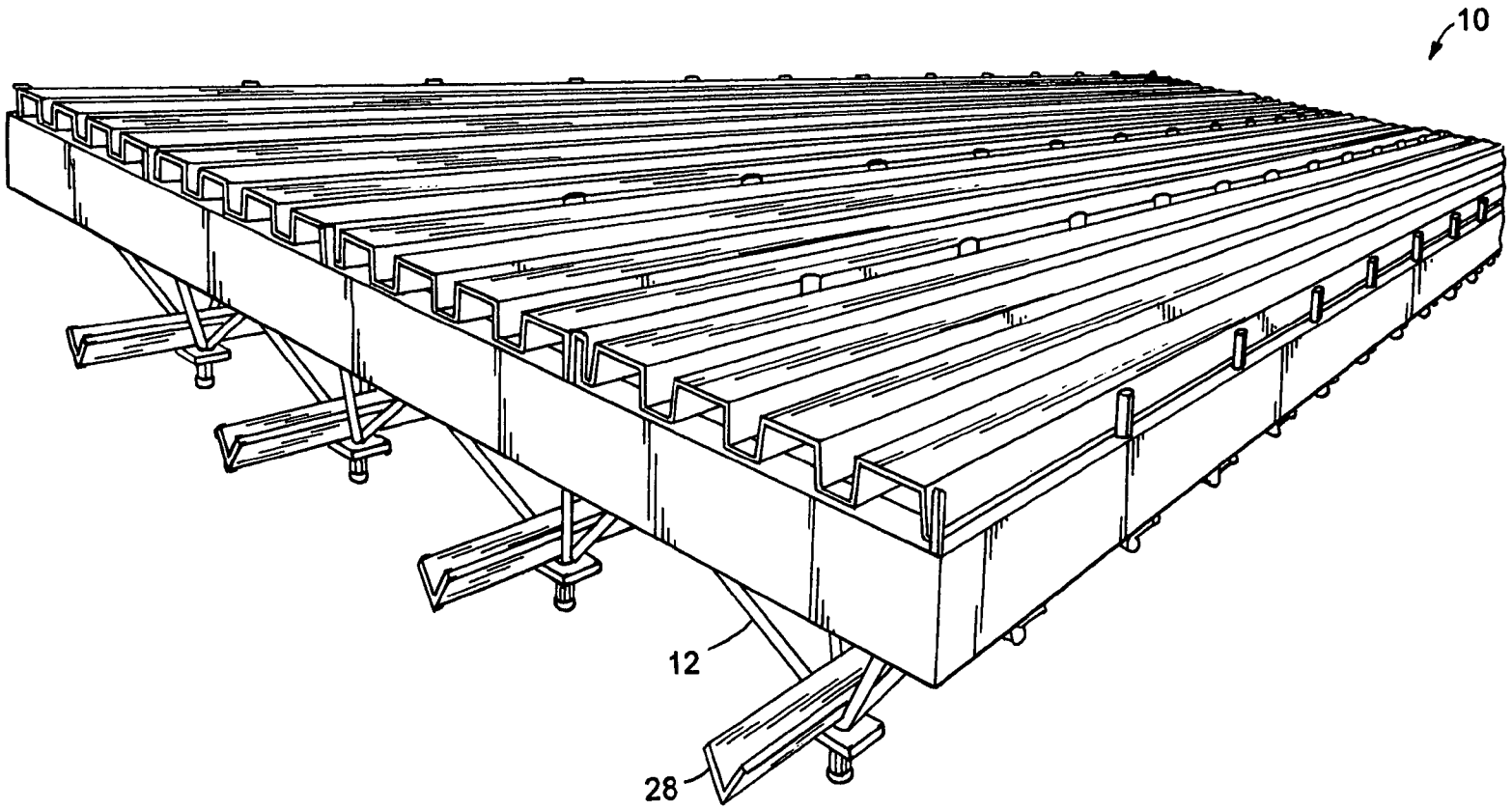
FIG. 17 is a perspective view illustrating a space truss system, constructed in accordance with the present invention, for supporting a structural steel deck structure ready for concrete topping slab.

As best illustrated in FIGS. 12-17, alternative space miss systems 10 of the present invention are illustrated. Depending on the embodiment, the space truss system 10 includes a perimeter frame 32, the bearing joist member 34, and a square tube 30 and/or angle iron 28. In other embodiments, the space truss system 10 includes bearing plate washers 36 and wooden sleepers 38. For instance, as illustrated in FIGS. 14 and 15, the space truss system 10 is constructed for supporting a wood deck structure. As illustrated in FIG. 16, the space truss system 10 is constructed for supporting a steel deck frame structure. As illustrated in FIG. 17, the space truss system 10 is constructed for supporting a structural steel deck structure ready for concrete topping slap.

Figure 19:
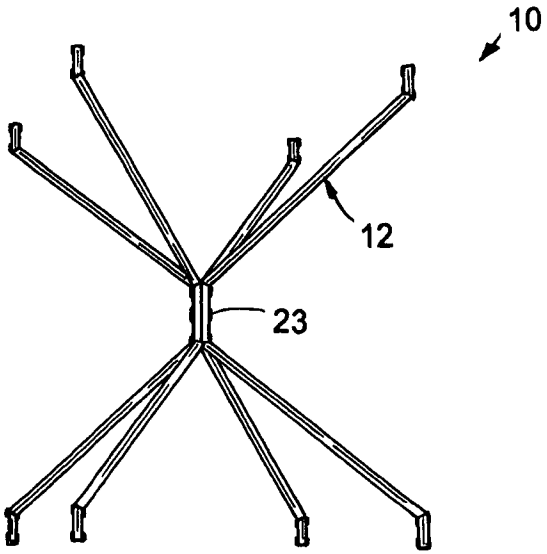
FIG. 19 is a perspective view illustrating a pair of grouped structural rods of the space truss system, constructed in accordance with the present invention, with the ends of the grouped structural rods secured together.
Figure 18:
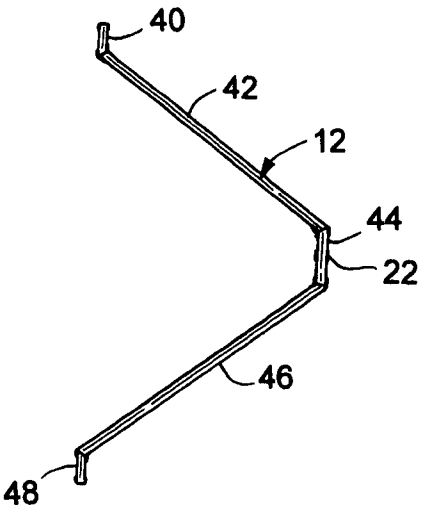
FIG. 18 is a perspective view illustrating a pair of structural rods of the space truss system, constructed in accordance with the present invention, with the ends of the structural rods secured together.
Figure 20:
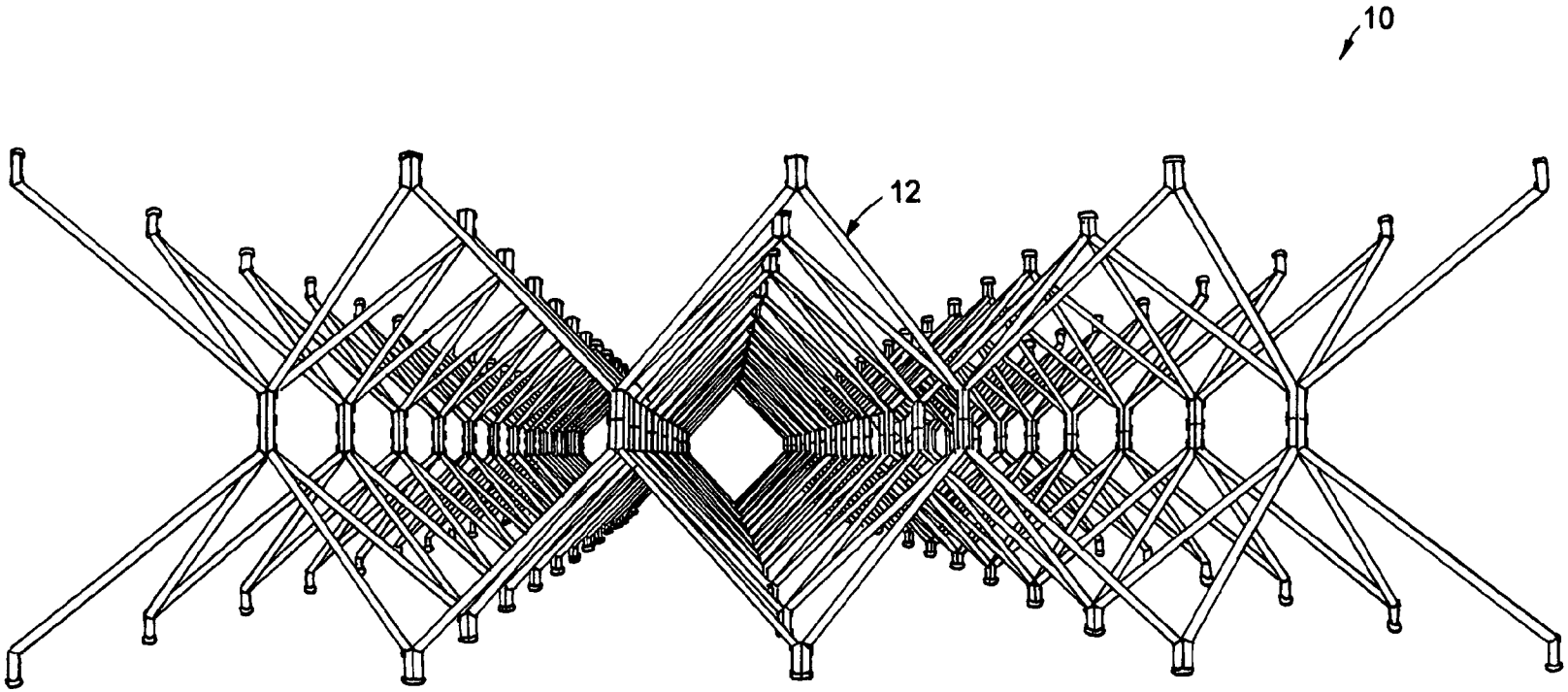
FIG. 20 is a perspective view illustrating a plurality of grouped structural rods of the space truss system, constructed in accordance with the present invention, all joined together at their ends.

As best illustrated in FIGS. 18-20, in a farther embodiment of the space truss system 10 of the present invention, the structural rods 12 can be bent twice such that each structural rod 12 has a first portion 40, a first middle portion 42, a center portion 44, a second middle portion 46, and a second portion 48. The first portion 40 is joined to the first middle portion 42, the first middle portion 42 is joined to the center portion 44, the center portion 44 is joined to the second middle portion 46, and the second middle portion 46 is joined to the second portion 48. Once again, it should be noted that while the actual lengths of the first portion 40, the first middle portion 42, the center portion 44, the second middle portion 46, and the second portion 48 can vary depending the requirements of the desired space truss system 10, it is preferable that the length of the first portion 40 is substantially equal to the length of the second portion 48 and that the length of the center portion 44 is substantially equal to the sum of the lengths of the first portion 40 and the second portion 48.

In a preferred embodiment, the first portion 40, the first middle portion 42, the center portion 44, the second middle portion 46, and the second portion 48 of the space truss system 10 of the present invention are formed from a single piece of material. It is, however, within tire scope of the present invention to form the first portion 40, the first middle portion 42, the center portion 44, the second middle portion 46, and the second portion 44 from different pieces of material with the ends of the portions welded or otherwise secured together.

The first portion 40 is joined to the first middle portion 42 at a first predetermined angle, the first middle portion 42 is joined to the center portion 44 at a second predetermined angle, the center portion 44 is joined to the second middle portion 46 at a third predetermined angle, and the second middle portion 46 is joined to the second portion 48 at a fourth predetermined angle. In a preferred embodiment, the first predetermined angle, the second predetermined angle, the third predetermined angle, and the fourth predetermined angle are substantially equal such that the first portion 40, the center portion 44, and the second portion 48 are parallel to each other although having the predetermined angles being non-equal to each other and the first portion 40, the center portion 44, and the second portion 48 being non-parallel to each other is within the scope of the present invention. Furthermore, preferably, the predetermined angles are approximately forty-five (45°) degrees although having the predetermined angles being less than or greater than forty-five (45°) degrees is within the scope of the present invention.

In this embodiment of the space truss system 10 of the present invention, in addition to the first portions 40 of the structural rods 12 being secured together and the second portions 48 of the structural rods being secured together, the center portions 44 are also secured together to essentially form a "double" space truss system 10. By creating the space truss system 10, as described and illustrated, there are two "pyramids" formed with the base of each facing each other and the apexes extending in opposite directions. This embodiment of the space truss system 10 adds strength and versatility to the design.

It should be noted that the preferred material for the space truss system 10 of the present invention is a metal material such as steel. However, the important feature of the space truss system 10 is the shape of the space truss system 10 and the use of other material in the construction of the space truss system 10 is within the scope of the present invention.

In addition, preferably, the structural rods of the space truss system 10 of the present invention are solid. However, as understood by those persons skilled in the art, all or part of the structural rods of the space truss system 10 can instead be hollow.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A space truss system for use in foundations, floors, walls, and roofs, the space truss system comprising:

a plurality of structural rods, each structural rod having a first portion having a first end and a second end, a middle portion having a first end and a second end, and a second portion having a first end and a second end;

wherein the second end of the first portion is joined to the first end of the middle portion at a first predetermined angle and the second end of the middle portion is joined to the second end of the second portion at a second predetermined angle;

wherein the first portions of at least a portion of the structural rods are grouped together forming a first pyramid structure, the first ends of the middle portions forming an apex of the first pyramid structure and the second ends of the middle portions forming a base of the first pyramid structure; and wherein the grouped first portions create a first post, and further comprising:

a first diaphragm having a first plurality of uniformly sized and uniformly shaped apertures spaced at regular intervals and disposed therethrough, each first post receivable within one of the apertures of the first diaphragm.

2. The space truss system of claim 1 wherein the first portion has a length substantially equal to a length of the second portion.

3. The space truss system of claim 1 wherein the first portion, the middle portion, and the second portion are integrally formed from a single piece of material.

4. The space truss system of claim 1 wherein the first predetermined angle is substantially equal to the second predetermined angle, the first portion being substantially parallel to the second portion.

5. The space truss system of claim 4 wherein the first predetermined angle and the second predetermined angle is approximately forty-five (45°) degrees.

6. The space truss system of claim 1 wherein upon grouping the first portions of the plurality of structural rods together, the angle between each pair of adjacent structural rods is substantially equal.

7. The space truss system of claim 1 wherein grouped second portions create a second post, and further comprising:

a second diaphragm having a second plurality of uniformly sized and uniformly shaped apertures spaced at regular intervals disposed therethrough, each second post receivable within one of the apertures of the second diaphragm.

8. The space truss system of claim 7 wherein the first diaphragm is positioned perpendicular to a longitudinal centerline of the first portions and the second diaphragm is positioned perpendicular to an additional longitudinal centerline of the second portions.

9. The space truss system of claim 7 wherein at least a portion of the first diaphragm and/or the second diaphragm are not perpendicular to the longitudinal centerline of the first portions and the second diaphragm is positioned perpendicular to an additional longitudinal centerline of the second portions.

10. The space truss system of claim 1 and further comprising:

at least one angle iron mounted directly beneath grouped first portions or directly above grouped second portions at the first end and the second end, respectively, of the middle portions.

11. The space truss system of claim 1 and further comprising:

a first diaphragm insert positioned around each grouped first portion;

wherein the first diaphragm insert is positionable within one of the apertures.

12. The space truss system of claim 7 and further comprising:

a second diaphragm insert positioned around each grouped second portion;

wherein the second diaphragm insert is positionable within one of the apertures.

* * * * *